United States Patent [19]

Zoltowski

[11] Patent Number: 4,747,885

[45] Date of Patent: May 31, 1988

[54] SOLUTION AND PROCESS FOR COATING METALS

[75] Inventor: Zigmund Zoltowski, Kingston-upon-Thames, England

[73] Assignee: Pyrene Chemical Services Limited, Buckinghamshire, England

[21] Appl. No.: 901,664

[22] Filed: Aug. 28, 1986

[30] Foreign Application Priority Data

Sep. 24, 1985 [GB] United Kingdom ..... 8523572

[51] Int. Cl.[4] ..... C23C 22/10

[52] U.S. Cl. ..... 148/6.15 R

[58] Field of Search ..... 148/6.15 R, 6.17

[56] References Cited

U.S. PATENT DOCUMENTS 4,220,486 9/1980 Matsushima ..... 148/6.17

*Primary Examiner*—Sam Silverberg

*Attorney, Agent, or Firm*—Arthur E. Kluegel

[57] ABSTRACT

A composition and process are useful for providing a corrosion resistant and lacquer receptive coating on the surface of drawn and ironed tin coated cans. The surface is contacted with an aqueous solution of tin containing ions, phosphate and an aromatic nitro compound at pH 1.5 to 3.5 preferably by spray application.

6 Claims, No Drawings

SOLUTION AND PROCESS FOR COATING METALS

BACKGROUND OF THE INVENTION

Cans for use as containers for food or drink are often formed from two parts, a cup and a can end. The cup at least is often formed from tin-plated steel, the tin coating providing corrosion resistance. The cups are usually made by drawing and ironing so that the wall especially is stretched considerably during the forming step. To reduce the cost of the raw materials it is desirable to use steel carrying a coating of tin which is as thin as possible. During the forming step the stretching of the thin tin coating often reveals areas of steel surface. These areas must be protected from corrosion.

It is known to coat the metal surface with a lacquer. The surface may be pretreated with an alkali degreaser/cleaner to improve adhesion of the lacquer, but the treatment by the alkali does not in itself improve the corrosion resistance.

It is known to provide a light iron phosphate coating on the insides of cans followed by a coating of lacquer. The conventional phosphating solutions do not coat tin metal so that conversion coating a surface having areas of iron and tin metals gives a surface having areas of tin metal and of iron phosphate. Although this may provide a satisfactory base for a subsequent lacquer coating, the discontinuities in the surface may show up undesirably, especially if the lacquer is transparent.

In GB Nos. 2033432 and 2068418 it is proposed to conversion coat tin-plated steel using a phosphating solution containing tin phosphate.

In GB No. 2033432 a conversion coating solution contains phosphate and stannous ions and a large excess of fluoride. The pH of the solution is in the range 5.5–6.5. In GB No. 2068418 a conversion coating solution contains phosphate and stannous ions, chlorate and/or bromate as accelerator and chloride ions and has a pH in the range 3.5–5.3 although it is stated the pH may be as low as 3. The processes in the two specifications do not however give satisfactory results. Often they are no better than using an alkali cleaner alone. The coating formed on the tin surfaces is often so thin as to be undetectable. The coating does not provide a satisfactory base for a subsequent lacquer coating nor does it provide a significant improvement in corrosion resistance.

SUMMARY OF THE INVENTION

According to the invention an aqueous conversion coating solution contains about 1.0 to 30 g/l phosphate, 0.01 to 5 g/l stannous ions, and a water-soluble aromatic nitro compound in an amount in the range 0.2 to 5 g/l and has a pH in the range 1.5 to 3.5.

A new process for phosphating a metal surface comprising iron and tin surfaces comprises contacting the metal surface with the new solution.

In the process for forming cans, a sheet of tin-plated steel is formed into a can body by the drawing and ironing and the surface of the cup is contacted with the solution.

Generally the phosphated metal surface is coated with a lacquer, which is subsequently cured.

DETAILED DESCRIPTION OF THE INVENTION

The new solution may be contacted with the metal surfaces by dipping, but, especially for coating cup-shaped metal products, it is preferable to spray the solution on to surfaces. Spraying is generally carried out at elevated temperature, suitably in the range 40° to 90° C. preferably 65° to 75° C. The solution is contacted with the metal surface for a period preferably in the range 10 to 60 seconds, for example about 20 seconds.

The solution may contain other additives which are stable at the temperatures of use. For example other accelerators may be included, generally nitrate. The solution may comprise fluoride ions, but is preferably free from fluoride, especially if the container is to be used for foods or beverages.

The concentration of tin ions in the conversion coating solution is generally in the range 0.05 to 0.2 g/l. The concentration of phosphate ions is generally in the range 2 to 10 g/l. The source of stannous ions is generally stannous chloride, but may be stannic chloride, stannous sulphate or sodium stannate.

The solution preferably contains chloride in an amount of from 0.6 to 12 times the weight of stannous ions present. Chloride is present in the solution generally in an amount in the range 0.05–2.0 g/l and suitably at a concentration at about 2–10 times the concentration of stannous ions.

The water-soluble organic nitro compound is suitably an aromatic sulphonic acid derivative, for example nitro benzene sulphonic acid or one of its salts e.g. an alkali metal or ammonium salt. Generally the compound is the solution in its free-acid form at the conditions of pH. It is present in the phosphating solution in an amount in the range 0.2 to 5 g/l, preferably about 0.5–2.0 g/l.

The pH of the coating solution is preferably in the range 1.8 to 3.0, most preferably about 2. With a coating solution having a pH above 3.5 the phosphate coating deposited on the surface is too thin to give any beneficial corrosion resistance effect. A coating solution having a pH of less than 1.5 tends to dissolve the metal from the surface at an undesirably fast rate and is thus unsuitable.

The total acidity of the coating solution may typically be 10 and the free acidity typically 3.3, with the ratio total acid: free acid typically 3.0.

The process of the invention provides a coating of phosphate containing iron and tin ions over the tin and iron surfaces of the metal product. The coating forms a good base on which to provide a lacquer coating.

The solution may be made up from a concentrate containing the appropriate ingredients in amounts such that the concentrate may be diluted to the desired concentration. Suitably however the chemicals for the process are provided as two separate concentrates. The first of the concentrates (replenishment concentrate) comprises phosphate ions and accelerator (water-soluble aromatic nitro compound) and alkali or acid so that the desired acidity level may be maintained. The second concentrate (starter concentrate) contains stannous ions and chloride ions together with alkali and/or acid.

At the start-up of the phosphating process, aliquots of both starter and replenishment concentrates are diluted with water to give a phosphating solution with the desired concentration of ingredients. The phosphating process is usually continuous and the phosphating solution may be replenished by continuously adding to it an appropriate amount of replenishment concentrate. At the pH levels of the phosphating solution tin metal is dissolved from the surface of a metal product having tin surfaces at a rate sufficient to provide stannous ions in the phosphating solution at the desired concentration, so that stannous ions do not need to be supplied in the replenishment solution.

The following illustrates the invention.

EXAMPLE

A starter concentrate comprises 20% by weight of a hydrochloric acid solution (35% by weight), 5.0% by weight stannous chloride ($SnCl_2$), 9.1% by weight of potassium hydroxide flake and is made up with tap water. A replenishment concentrate contained 25% by weight ortho phosphoric acid (75% by weight), 5.0% by weight soda ash (light), 2.8% by weight sodium nitro benzene sulphonate and is made up with tap water. The start-up solution for the phosphating process comprises 3 ml of the starter concentrate and 30 ml of the replenishment concentrate per liter of solution. The pH of the solution at 70° C. was approximately 2. The solution contained about 6 g/l phosphate ions, about 0.1 g/l stannous ions, about 0.3 g/l chloride ions and about 1 g/l nitro-benzene sulphonic acid.

The phosphating solution was contacted with tin-coated steel cans pressed from sheet tin-plated steel by spraying at between 65° C. to 75° C. for about 20 seconds. The concentration of the phosphating solution was metered by continually measuring the acidity of the solution. To increase the acidity, the phosphating solution was replenished by adding an appropriate amount of the replenishment concentrate.

What is claimed is:

1. An aqueous conversion coating solution comprising about 1.0 to 30 g/l phosphate, 0.01 to 5 g/l stannous ions and 0.2 to 5 g/l of a water-soluble aromatic nitro compound, which has a pH in the range 1.5 to 3.5.

2. A solution according to claim 1 in which the aromatic nitro compound is an aromatic sulphonic acid, preferably a nitrobenzene sulphonic acid, or an alkali metal or ammonium salt thereof.

3. A solution according to claim 1 additionally containing chloride in an amount of 0.6 to 12 times the amount of stannous ions (by weight).

4. A solution according to claim 1 which is substantially free of fluoride.

5. A solution according to claim 3 containing from 0.05–2.0 g/l chloride.

6. A concentrate containing stannous ions, phosphate ions and a water-soluble aromatic nitro compound wherein these ions are in 9 weight ratio as set forth in claim 1 and are capable of being diluted to form a solution according to claim 1.

* * * * *